US005890330A

United States Patent [19]

Lesage

[11] Patent Number: 5,890,330

[45] Date of Patent: Apr. 6, 1999

[54] ADJUSTABLE STAIRCASE

[76] Inventor: Gilles Lesage, 2 rue Pasteur, F-91660 Mereville, France

[21] Appl. No.: 776,255

[22] PCT Filed: Jul. 18, 1995

[86] PCT No.: PCT/FR95/00964

§ 371 Date: Jan. 21, 1997

§ 102(e) Date: Jan. 21, 1997

[87] PCT Pub. No.: WO96/02716

PCT Pub. Date: Feb. 1, 1996

[30] Foreign Application Priority Data

Jul. 18, 1994 [FR] France ..... 94 08850

[51] Int. Cl.[6] ..... E04F 11/00

[52] U.S. Cl. ..... 52/183; 182/156

[58] Field of Search ..... 52/182, 183, 191; 182/1, 115, 152, 156, 159, 194

[56] References Cited

U.S. PATENT DOCUMENTS

| | | | |
|---|---|---|---|
| 3,299,590 | 1/1967 | Carter | 52/183 |
| 3,765,137 | 10/1973 | Loix . | |
| 4,959,935 | 10/1990 | Stob | 52/183 |
| 5,189,854 | 3/1993 | Nebel | 52/183 |

FOREIGN PATENT DOCUMENTS

| | | |
|---|---|---|
| 0033045 | 8/1981 | European Pat. Off. . |
| 1581070 | 9/1969 | France . |
| 2114749 | 6/1972 | France . |
| 1778509 | 2/1972 | Germany . |
| 2509464 | 9/1976 | Germany . |
| 3421627 | 12/1985 | Germany . |

*Primary Examiner*—Carl D. Friedman
*Assistant Examiner*—Beth A. Aubrey
*Attorney, Agent, or Firm*—Greer, Burns & Crain, Ltd.

[57] ABSTRACT

Adjustable steps (2) extend between two parallel stingboards (3). Each stringboard (3) includes two locking flanges (4) and each step (2) is supported by four pivotable blocks (7, 8) each securable to a flange (4) by means of a nut (17). Two threaded rods (13, 16) extending through the step and between the stringboards engage two respective nuts (17) combined with two opposite blocks. The height of each step of the staircase may be adjusted by changing the spacing between the blocks (7, 8) along each flange (4). The horizontal position of the steps may be adjusted by changing the vertical distance between the front blocks (7) and rear blocks (8) along the stringboards, regardless of the angle at which the stringboards were fitted. A universal staircase may thus be achieved.

20 Claims, 4 Drawing Sheets

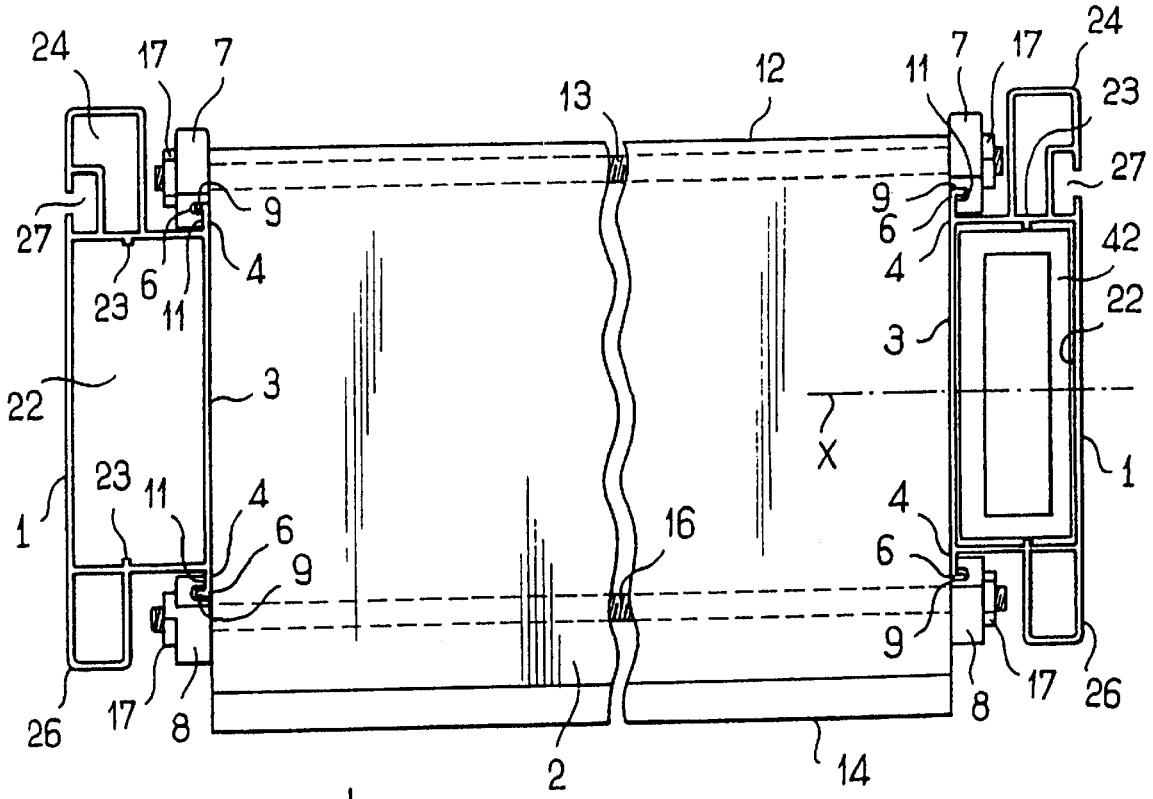
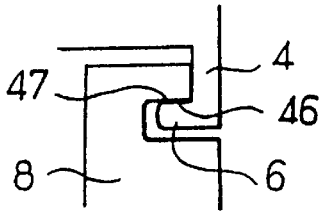
FIG_2B FIG_2A
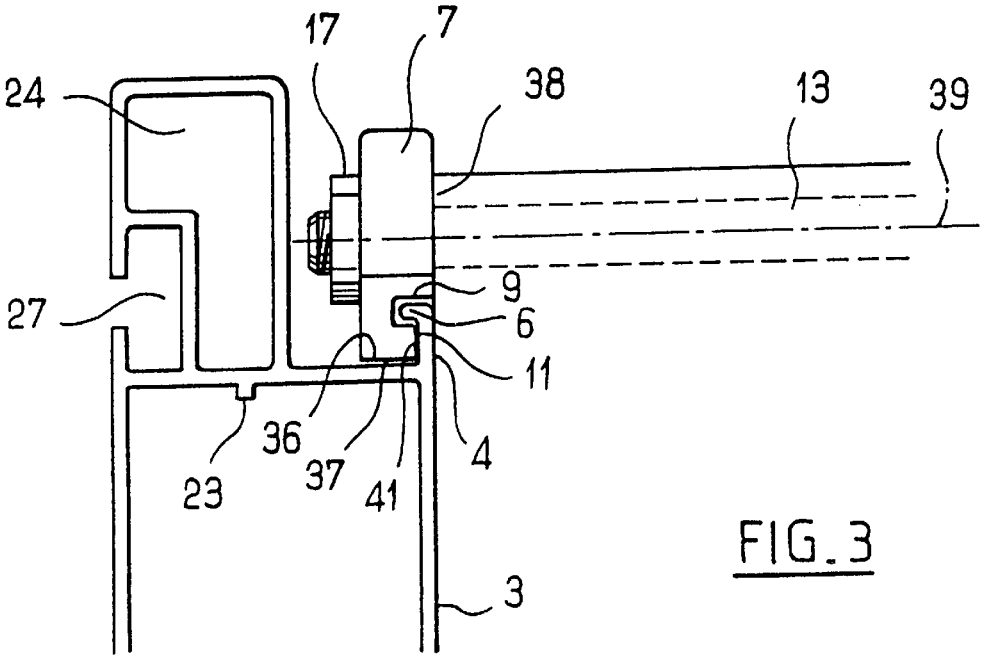
FIG_3

ADJUSTABLE STAIRCASE

BACKGROUND OF THE INVENTION

The present invention relates to steps having a variable configuration.

In order to take into account each particular configuration, which determines the slope of the strings and the distance between treads, made-to-measure steps can be manufactured, which are supplied assembled, or which on the other hand can be assembled on site. Such steps are expensive both to manufacture and to install.

Some known steps have an adjustable configuration but their structural components are still expensive. Thus steps are known according to DE-A-1 778 509 in which the treads have on each side two angle-irons pierced by a hole in order to allow locking in an adjustable position in a slide of the strings. These steps are expensive to manufacture with several welded pieces. A stock must be kept of different treads for the different widths of steps. The rigidity of the steps depends on the rigidity of the angle-irons.

The object of the invention is to propose steps having a variable configuration which are particularly simple to make and to install.

SUMMARY OF THE INVENTION

According to the invention, the steps having a variable configuration comprises two parallel strings, treads intended to extend parallel to one another each between the two strings, and means of fixing the treads in an adjustable position between the two strings, characterized in that the means of fixing comprise for each tread at least one rod extending over the whole width of the tread and at each end of which a respective clamping means is fitted in order to press the two strings one towards the other with compression of the tread forming a strut.

As the treads are fixed in the manner of mere struts between the strings, they can if so desired be obtained by mere cutting of a profiled section. There is no longer any need to add lateral fixing flanges to them. Assembly is very quick, and the rigidity of the unit which is obtained is improved thanks to the rigid and compressed bracing which the treads define between the strings. The presence of at least one rod over the whole width of the tread reinforces the latter against deflection under the weight of the user or users. In order to make steps having a determined width, it is enough to cut the profiled section of the treads to the corresponding length, and to use rods of a likewise corresponding length.

The assembly of the steps can be a simple and quick operation, requiring neither particular skill nor complicated tools. The clamping means can be detachable, allowing the steps to be dismantled and reassembled on another site, with another configuration.

These steps having a variable configuration in which the treads and the two strings preferably consist of aluminium profiled sections can have other characteristics. The strings can be reinforced by elements, made from steel, sliding in the inside of the aluminium profiled section. And in order to facilitate further the fixing of the steps at the same time to the ground and to the top of the vertical wall against which the steps are placed, screwable angle-irons and sectors can be supplied with the steps.

The steps can be marketed in kit form.

BRIEF DESCRIPTION OF THE DRAWINGS

Other particular features and advantages of the invention will emerge from the following description, which relates to non-limiting examples, and with reference to the drawing in which:

FIG. 2 is a view of the steps from above showing a tread, the profiled sections of the two lateral strings and four corresponding fixing means;

FIG. 3 is a detailed view of one of the fixing means;

DETAILED DESCRIPTION OF THE INVENTION

Figure 1:
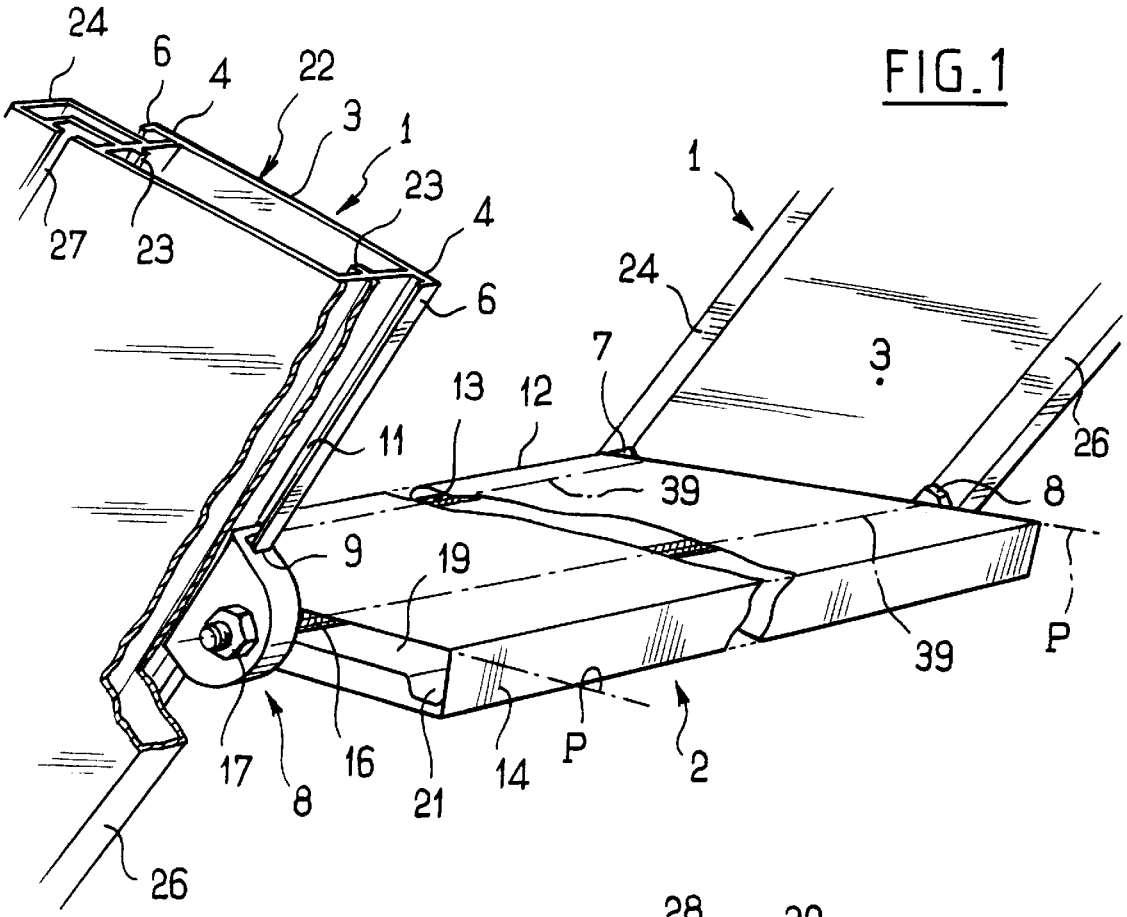
FIG. 1 is a perspective view of a tread of the steps and of two strings with a broken away portion showing the means fixing the tread to the string.

In the example presented in the figures, the steps comprise two lateral parts—or strings—(1) made from an aluminium profiled section and treads (2) extending parallel to one another each between the two strings.

Each profiled section or string has a wall (3) which is turned towards the other string and extended along each of its edges by two clamping flanges (4) each ending in a guide rib (6) bent in the direction pointing away from the other string. The two lateral edges of the tread are situated against the wall (3) of the two opposed strings.

Fitted in the vicinity of the four angles of each tread are four pivoting blocks (7, 8) each having a groove (9).

Each block is, at least prior to clamping, freely pivotable relative to the plane of the tread about an axis (39) parallel to the width of the tread.

But when the steps are assembled, each block is immobilized in order to prevent rotations about its axis (39) relative to the corresponding string. To achieve this, the grooves (9) of the blocks straddle the ribs (6) which run parallel to the longitudinal direction of the string (1).

Each block comprises two clamping faces. These two clamping faces are situated on either side of the groove (9) on each block. They are offset by a distance corresponding to the thickness of the flange (4). One (38) (FIG. 3) is designed so as to rest against the corresponding lateral edge of the tread, and the other (11) is designed so as to rest against a clamping face (41) of the string, which face (41) faces away from the tread, and is carried by the clamping flange (4).

The two front blocks (7), situated at the two ends of the tread nose (12), are crossed by one and the same front threaded rod (13) extending in the inside of the tread along the tread nose, in a housing having a diameter very slightly greater than that of this rod. Thus, the front threaded rod (13) is simply mobile in rotation in the inside of the tread nose, without being able to move away from the tread nose.

The two rear blocks (8), which lie next to the rear edge (14) of the tread, are identical to the front blocks (7). They are crossed by one and the same rear threaded rod (16)

passing on the inside of the tread. On the other hand, this rear threaded rod (16) can slide freely in a housing (19) situated inside the tread and below the upper plane P of the tread (2). This housing (19) extends along the rear edge (14) of the tread with a certain depth in the direction of the tread nose, and a height very slightly greater than the diameter of the threaded rod (16). Thus the rear threaded rod (16) of each tread is situated at a freely adjustable distance from the front threaded rod (13). Each block is associated with a nut (17) screwed onto the threaded rod.

Each block can, by screwing of the nut (17) onto the corresponding threaded rod, be pressed towards the tread which carries it. The blocks thus clamp the strings against the treads, which form braces between the strings. In addition, the threaded rods reinforce the treads against deflection. The tread (2) will thus be fixed on the two strings in a position freely chosen by the user.

Thus, in placing the front blocks (7) of the different treads at a chosen distance between them, the height of the treads of the steps is adjusted.

In addition, prior to clamping of the blocks, the tread (2) can be pivoted about the front rod (13) in order to stagger the rear blocks (8) to a greater or lesser extent vis-à-vis the front blocks (7) of the tread relative to the length of the strings. This achieves a correlative variation of the distance between the front rod (13) and rear rod (16) of the tread by means of sliding of the rear rod (16) in the housing (19). Thus there is an adjustment of the inclination which it is proposed to give to the strings when the steps are installed, it being understood that it is generally wished for the plane P of the treads to be horizontal.

Despite this great mobility of the tread prior to the clamping of the blocks, the accident risks due in service to loosening or poor clamping of a block are very limited. In fact, each front block (7) and rear block (8) comprises a retaining face (36; 46) which, in operation, is parallel and adjacent to a longitudinal support face (37; 47) arranged on the string in such a way as to be directed upwards when the string is in an inclined position in the installed steps. Thus, even in the case of loosening of a clamping means (7 or 8), the resting of the retaining face (36 or 46) on the longitudinal support face (37 or 47) opposes the downward movement of the tread under the action of the weight of the person using the steps.

In order that the fixing of the treads is stable, an adequate distance is necessary between the front blocks (7) and rear blocks (8). This must be achieved even when the rear rod (16) is abutting against the end of the housing (19) that is closest to the tread nose, that is to say when it is brought as close as possible to the front rod (13), thus when the angle between the plane of the tread and the longitudinal direction of the strings is at its maximum (case of very steep steps). In other words, it is necessary for the distance between the two guide flanges (6) of a single string to itself be sufficient. However, this means that the tread must be of a depth (distance between the nose (12) and the rear edge (14)) that is sufficient to enable the two threaded rods to also have between them a greater distance corresponding to the position in which the angle between the treads and the longitudinal direction of the strings has its minimum contemplated value (case of steps that are not steep at all). This tends to result in treads that are needlessly deep, particularly compared with the standard depth. In order to remedy this disadvantage, the housing (19) in which the rear rod (16) can slide in order to move away to a greater or lesser extent from the front rod (13) is ended, along the rear edge (14) of the tread, by a recess (21) which is such that the two extreme positions of the rear rod (16) are on a line L (FIG. 2) which is inclined to the rear relative to the plane of the tread. This allows the rear rod to be lowered relative to the plane P of the tread, in other words to raise the rear of the tread relative to the plane defined by the two rods (13, 16). There is thus a saving of some degrees of angle of inclination of the treads without a corresponding increase in their depth.

Each string has a hollow profiled body (22) having a generally rectangular cross-section in which a reinforcing profiled section (42) (right-hand part of FIG. 2), made of steel for example, can be slid, in particular with a view to reducing the flexibility of very long steps.

The hollow profiled body has, along its front and rear inner faces, parallel to the bending axis X of the string, two longitudinal ribs (23) allowing the reinforcing profiled section to slide without play, but without excessive rubbing, inside the hollow body (22). When the strings have a tendency to bend, they are prevented from doing so because the ribs (23) rest against the reinforcing profiled section (42).

The cross-sectional profile of each string also has two reinforcing appendages (24) and (26). The first (24) is connected to the front face of the hollow body (22), which is directed towards the tread nose. The second (26) is connected to the rear face of the hollow body (22), which is directed towards the rear edge of the tread.

The front appendage (24) comprises, on its face facing away from the other string, a groove (27) in the form of a profiled T-section for the fixing of accessories such as a railing.

Figure 5:
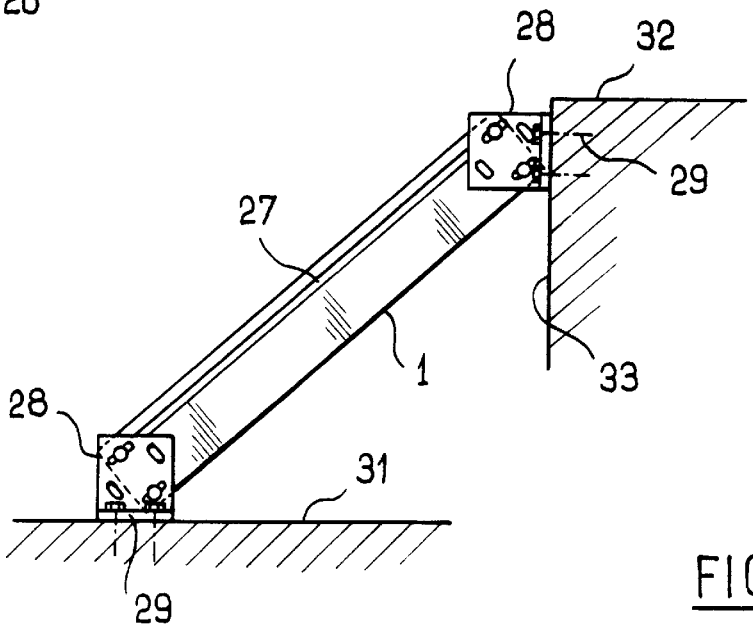
FIG. 5 is a side view showing a complete lateral string and the means of fixing this string to the ground and flat against the vertical wall against which the steps are rested.

As can be seen in FIG. 5, there are provided, for fixing the strings to the ground, angle-irons (28) which can be fixed in an adjustable angular position against the outer face of the strings, in such a way that the free flange (29) of these angle-irons is rested on the ground (31) and can be screwed to it.

The same angle-irons (28) can be used for the fixing (1) of the strings to the higher level (32) which the ladder makes it possible to reach. In this case the angle-iron is positioned in such a way that its free flange (29) is directed vertically and can be screwed flat against the vertical wall (33) against which the steps are rested.

For the fixing of the angle-irons (28), use can be made in particular of the presence of the groove (27) and/or additional holes can be made in the wall of the hollow body (22) and/or of the appendage (26).

Figure 6:
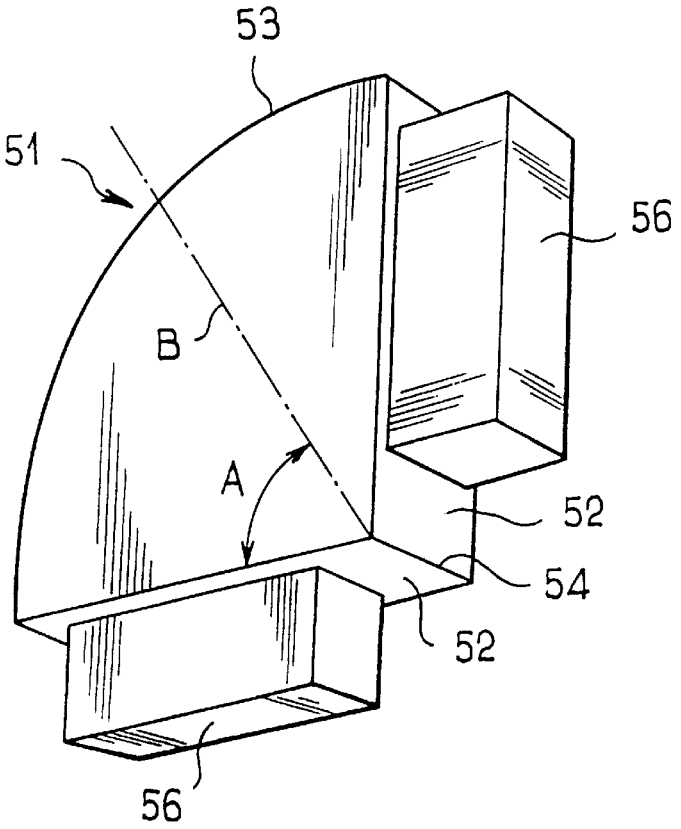
FIG. 6 is a perspective view of the element that can be cut into two sectors which can be adapted to the ends of the string.
Figure 7:
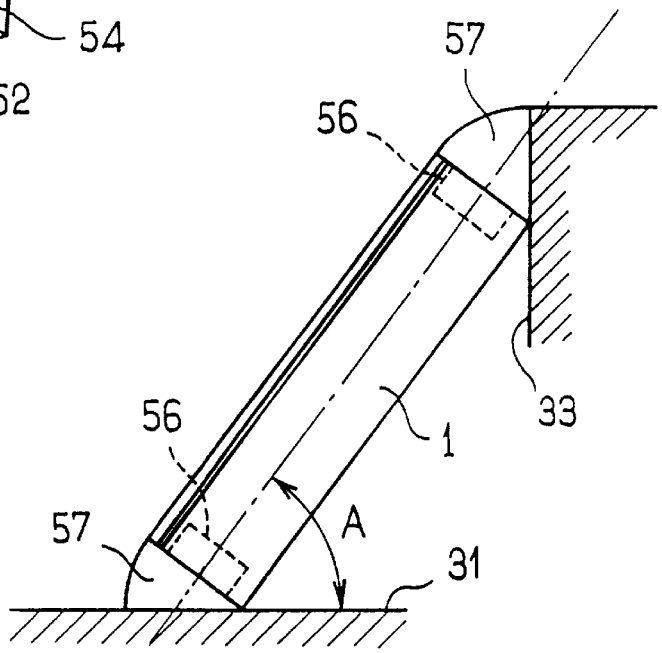
FIG. 7 is a side view showing a complete lateral string in position on site and the two sectors which can be adapted to the ends of the string.

In the example presented in FIG. 6, the steps also comprise, for each string, an element (51), in particular of wood, comprising two faces (52) at right angles and a cylindrical face (53) having for a geometric axis the edge (54) between the two faces at right angles (52). Each face (52) bears a rectangular tenon (56) which can be fitted into the hollow body (22) of the strings. Once the angle of inclination (A) which the strings will assume on site is determined (FIG. 7), the element (51) is cut along the plane (B) passing through the edge (54) and forming the same angle (A) with one of the faces (52). It is then sufficient to fix the two pieces (57) which are thus obtained to the two ends of a single string by fitting the tenon (56) into the end of the hollow body (22) of the string in order to fill the space in the form of a sector between each end of the strings with on the one hand the ground (31) and respectively the vertical wall (33) on the other.

Either the sectors (57) can be fixed to the ground (31) and respectively onto the wall (33) in order to ensure, thanks to them, the fixing of the steps, or the sectors (57) can also be used as finishing pieces and fixing ensured by means of mountings such as (28) (FIG. 5).

Steps such as have been described up until now can be marketed in kit form. In this case, the person installing the steps according to the invention determines, according to the difference in level and the slope of the steps which he wishes to achieve, the length of the strings and the number of treads needed. He purchases two strings made from a profiled section cut to length, and the desired number of treads. Then he assembles, adjusts and fixes the treads, where necessary positions the sectors then fixes the steps thanks to the angle-irons.

The steps of the described examples can be completely dismantled and then reinstalled on another site. This is particularly of interest for example when equipping work sites.

Figure 4:
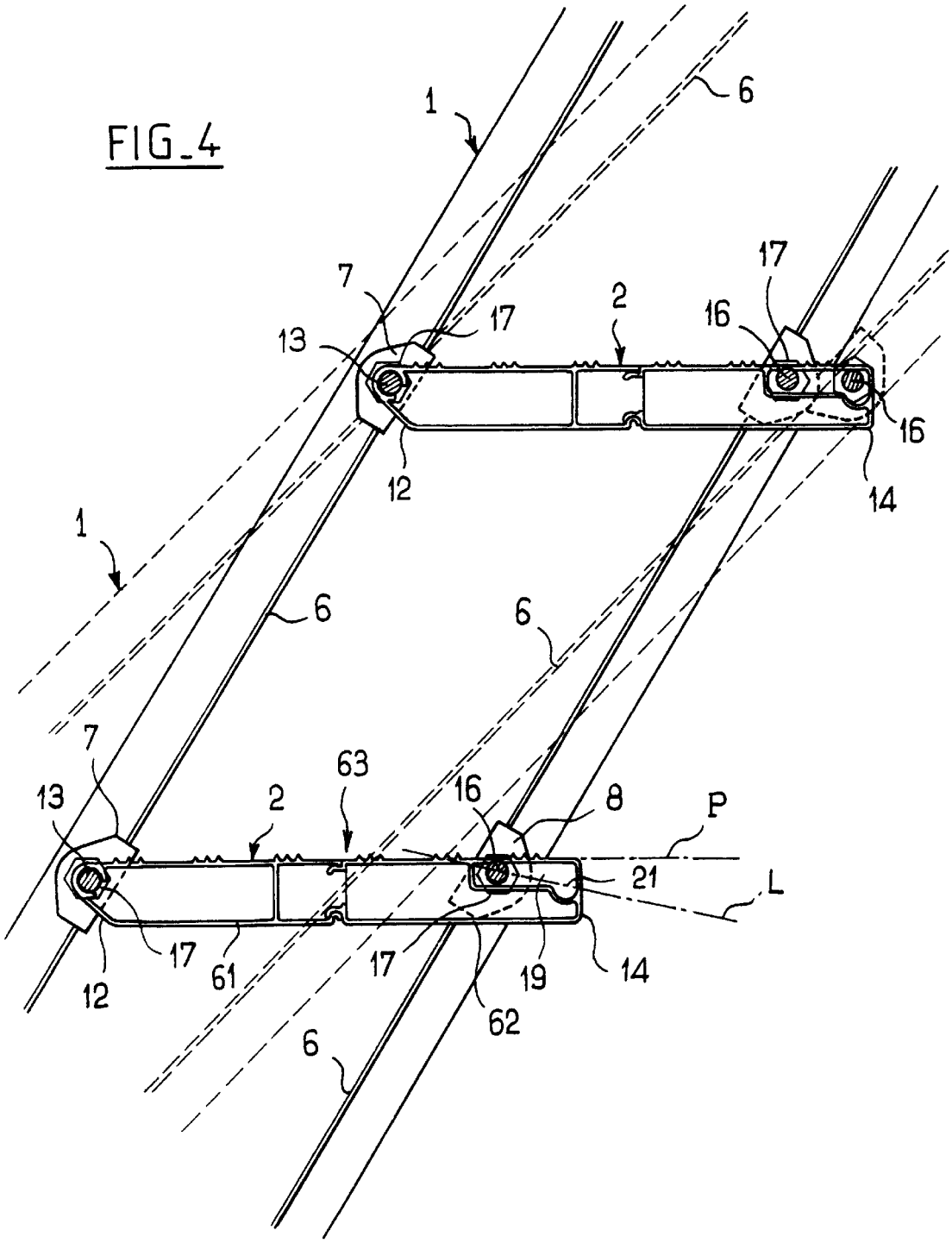
FIG. 4 is a side view showing the inclined lateral string and, showing through, two successive horizontal treads and also their associated fixing means, another possible inclination of the string being represented by dotted lines.

In the example represented in FIG. 4, each tread is made in the form of two half-treads 61, 62 connected to each other by a snap fit 63. The joint that is thus created is parallel to the width of the tread, that is to say perpendicular to the plane of FIG. 4. An aluminium profiled section for treads made from a single support would, because of the large measurements of its profile, be much more costly to make than the aluminium profiled sections allowing the half-treads to be made.

Figure 8:
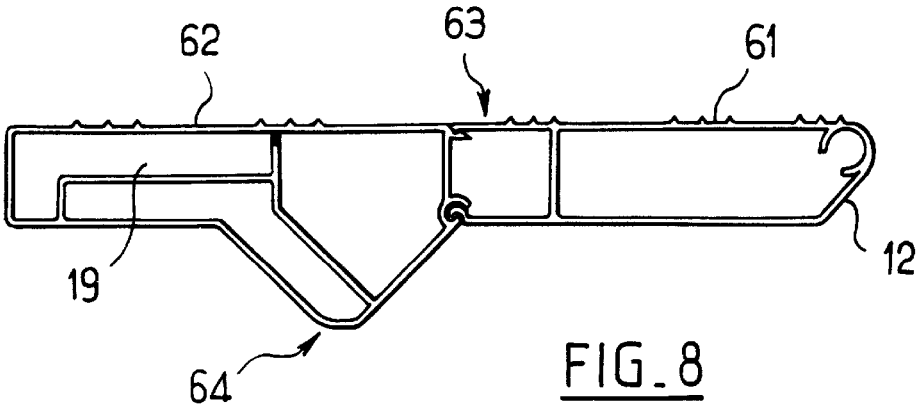
FIG. 8 is a sectional view of a variation on the realization of a tread.

This structure is also found in the example represented in FIG. 8. However, the profile of the rear half-tread has an enlarged section 64 on its lower face. This is useful for increasing the rigidity of the treads when the width of the steps is relatively great.

According to a variant which is not represented, the reinforcement can be provided by a third profiled section, higher than the half-treads 61 and 62 of FIG. 4, and which, by means of a snap fit, is mounted between the half-treads 61 and 62 of FIG. 4, either in all cases, or solely when relatively wide steps have to be made.

The invention is, naturally, not limited to the examples which have been described and represented. For example, the retaining engagement between the front blocks and the strings could be created between the upper face of the front guide flange (6) and the adjacent face of the block.

For connection of the string ends to the ground (31) and the vertical wall (33), end pieces can also be made which can be fixed to the ends of strings for example by being fitted into the hollow body, and to each of which is articulated, about an axis parallel to the width of the treads, an angle-iron, the free flange of which can be fixed against the ground (31) or respectively the vertical wall (33).

I claim:

1. A set of adjustable steps comprising: two parallel strings, each having an outer face, treads which extend parallel to one another, each such tread having two end faces, a width and a depth, being disposed along a widthwise direction, and being disposed between the two strings, and means for fixing the treads in an adjustable position between the two strings, the fixing means for each tread comprising at least one rod having two ends and extending over the whole width of the tread and at each end of the at least one rod a respective clamping means is fitted to exert a clamping force for pressing the two strings one towards the other with compression of the tread forming a strut.

2. The steps according to claim 1, wherein each clamping means comprises a nut screwed on the corresponding end of the rod in order to press the two strings against the two end faces of the tread.

3. The steps according to claim 1, wherein the treads are made from profiled cut sections.

4. The steps according to claim 1, wherein the fixing means comprise, for each tread, two rods spaced apart from each other in the direction of the depth of the tread, and each rod is fitted with one of the clamping means at each of said ends, the clamping means of at least one of the rods being adjustable with respect to the strings.

5. The steps according to claim 4 wherein, in order to permit adjustment of an orientation of the treads relative to the longitudinal direction of the strings, at least one of the rods is displaceable in the direction of the depth of the tread.

6. The steps according to claim 5, wherein each tread has a rear edge and defines a plane, and comprises a guide for the displaceable rod, said guide having two ends which are on a line inclined towards the rear edge of the tread, relative to the plane of the tread.

7. The steps according to claim 1, wherein the clamping means further comprises an adjustment slide fitted on each of the strings to exert the clamping force.

8. The steps according to claim 1, wherein the clamping means are, at least prior to clamping, freely pivotable relative to a plane of the tread, and comprise a retaining face which is parallel and adjacent to a longitudinal support face arranged on the strings to be directed upwards when the steps are installed, in such a way that even in the case of loosening of the clamping means, the downward movement of the tread under the action of the weight of the person using the steps is countered by resting of the retaining face on the support face.

9. The steps according to claim 1, wherein each clamping means comprises a block which is pivotable about an axis parallel to the width of the tread, and means for immobilizing the block relative to the corresponding string against rotations about said axis.

10. The steps according to claim 9, wherein the means for immobilization are coupling means of a rib and groove, the rib and groove being parallel to the longitudinal direction of the string.

11. The steps according to claim 10, wherein each string comprises two opposed clamping flanges adjacent to each of the end faces of tread, with each clamping flange connected by a bend to said rib, the bend extends from the tread, and in which each block comprises a groove for straddling the rib and a clamping face for resting on the clamping flange.

12. The steps according to claim 1, wherein each clamping means comprises a block having two clamping faces, one for resting against a lateral edge of the tread, the other for resting against a string face facing away from the tread, and means for pressing the block towards the tread.

13. The steps according to claim 1, wherein each string is made from a hollow aluminum profiled section.

14. The steps according to claim 1, wherein each string has a hollow profiled section which comprises a body in the form of a box having at least one inside face having at least one longitudinal rib.

15. The steps according to claim 1, wherein each string has a hollow profiled section which includes a longitudinal reinforcing means made of steel.

16. The steps according to claim 1, wherein each string comprises a profiled means for the fixing of accessories such as a handrail.

17. The steps according to claim 1, further including by universal mountings that are fixable against the outer faces of the strings adjacent each of said ends, and comprising a flange in the form of an angle-iron for fixing on the ground or respectively on a vertical wall against which the steps can be rested.

18. The steps according to claim 1, further including string end support elements having two faces at right angles and comprise means for fixing to ends of the strings, and which are separable into two sectors, the angles of which are chosen as a function of the slope of the strings.

19. The steps according to claim 1, wherein the treads are fixable in a detachable manner to the strings.

20. The steps according to claim 1, wherein the treads are made from at least two profiled sections fixed to each other, joined by a joint extending along the width of the treads.

* * * * *

UNITED STATES PATENT AND TRADEMARK OFFICE

CERTIFICATE OF CORRECTION

PATENT NO. : 5,890,330
DATED : April 6, 1999
INVENTOR(S) : Giles Lesage

It is certified that error appears in the above-indentified patent and that said Letters Patent is hereby corrected as shown below:

On the title page:

Under "[57] Abstract" delete "stinborads"

and insert--stringboards-- therefor;

Column 2, line 4, delete "2" and insert

--2A-- therefor

Column 2, between lines 6-7, insert --Figure 2B is a close-up view of one of the fixing means-- therefor Column 6, line 39, before "tread" insert --each--

Column 6, line 60, delete "by"

Signed and Sealed this

Nineteenth Day of October, 1999

*Attest:*

Q. TODD DICKINSON

*Attesting Officer*

*Acting Commissioner of Patents and Trademarks*